US005899666A

United States Patent [19]

Chung et al.

[11] Patent Number: 5,899,666

[45] Date of Patent: May 4, 1999

[54] ION DRAG VACUUM PUMP

[75] Inventors: Kwang-Hwa Chung; Hong-Young Jang, both of Taejeon, Rep. of Korea

[73] Assignee: Korea Research Institute of Standards and Science, Taejeon, Rep. of Korea

[21] Appl. No.: 08/918,279

[22] Filed: Aug. 25, 1997

[30] Foreign Application Priority Data

Aug. 27, 1996 [KR] Rep. of Korea ..... 96-35704

[51] Int. Cl.[6] ..... F04F 11/00

[52] U.S. Cl. ..... 417/49; 417/48; 417/50

[58] Field of Search ..... 417/49, 48, 50

[56] References Cited

U.S. PATENT DOCUMENTS 3,827,829 8/1974 Tom ..... 417/49

4,812,711 3/1989 Torok et al. ..... 417/48

*Primary Examiner*—Timothy S. Thorpe

*Assistant Examiner*—Cheryl J. Tyler

*Attorney, Agent, or Firm*—Anderson, Kill & Olick, P.C.

[57] ABSTRACT

An ion drag vacuum pump is installed in a body, one side of which is connected to and in communication with a sealed chamber. An ion generating device and a positive ion dragging device for dragging positive ions generated by the ion generating device to exhaust gases located near the ions by speeding up the ions is disposed in the body. The positive ions are neutralized by a positive ion neutralizing device. The ion generating device includes a corona electrode as a corona discharger to which a positive voltage is applied, a metal plate as a DC glow discharger to which a positive DC voltage is applied, or a first RF electrode and a second RF electrode to which RF power is applied. The ion dragging device includes a target electrode or a first and a second grids to which a positive and a negative voltage are respectively applied. The ion neutralizing device includes a grounded baffle plate.

10 Claims, 7 Drawing Sheets

ION DRAG VACUUM PUMP

FIELD OF THE INVENTION

The present invention relates to a vacuum pump; and more particularly, to a vacuum pump utilizing an ion drag phenomenon.

BACKGROUND OF THE INVENTION

There have been developed a number of vacuum pumps which attain a vacuum state inside an enclosure by letting gas molecules collide with and get pumped out by fast moving solid, liquid or gas. One example of such pump is a turbomolecular pump. In order for these pumps to obtain an ultra-high vacuum state, however, these pumps must be provided with a mechanical vacuum pump, e.g., a rotary pump or a roots pump, as a back-up pump, making them structurally complicated.

Furthermore, there have been developed other pump using ion-transport effect, a sputter-ion pump and the like. In the sputter-ion pump, the molecules are ionized by electrons moving in helical path in high magnetic field.

The ions thus generated are accelerated to a cathode made of getter materials like Ti or Ta, and sputter the cathode, forming getter film on an anode. This sputtered getter film then removes gases from the enclosure by binding the gases to the surface. This pump, however, operates only in high vacuum, and needs a roughing pump to start with Further, there is disclosed a vacuum pump in U.S. Pat. No. 4,641,060, entitled "METHOD AND APPARATUS USING ELECTRON CYCLOTRON HEATED PLASMA FOR VACUUM PUMPING", capable of producing a gas pumping plasma within an evacuated enclosure having a collimating system consisting of baffle plate structures and a magnetic field having a central uniform region connected to a source of neutral gas, a magnetic mirror intermediate region and a terminating divergent region. In this apparatus, a desired vacuum level is attained in an enclosure therein by: evacuating the enclosure to a selected pressure; feeding high frequency microwave energy of a selected power and frequency into the magnetic mirror intermediate region; and establishing the magnetic field at a strength such that an electron cyclotron frequency is made to equal to the frequency of the microwave energy within the intermediate region electrons within the magnetic mirror intermediate region, being heated by the microwave energy, the heated electrons ionizing the neutral gas in the intermediate and central regions for creating and maintaining a pumping plasma. Baffle plate structures are provided between the central and intermediate regions and between the intermediate and terminal regions for permitting unobstructed flow of plasma along the magnetic field lines to the terminal region while restricting inward flow of neutral gas resulting from recombination in the terminal region. The plasma is preferably composed of ionized neutral gas from the central and intermediate regions and an adequate neutral gas concentration is maintained in the intermediate region by controlled supply of make-up gas.

This pump, however, as in the case of turbomolecular pumps, must be equipped with a back-up pump. Further, since it utilizes microwave and a large number of magnets for controlling the plasma flow, it is structurally complicated and expensive to construct.

SUMMARY OF THE INVENTION

It is, therefore, a primary object of the invention to provide an ion drag vacuum pump which can operate under atmospheric pressure without any back-up pump and has no moving part.

In accordance with one aspect of the present invention, there is provided an ion drag vacuum pump comprising: a body, one side of which is connected to and in communication with a sealed chamber; means disposed in the body for generating ions; means disposed in the body for dragging positive ions generated by the ion generating means to thereby exhaust gases located near the ions outside by speeding up the ions; and means for neutralizing the positive ions.

BRIEF DESCRIPTION OF THE DRAWINGS

The above and other objects and features of the instant invention will become apparent from the following description of preferred embodiments taken in conjunction with the accompanying drawings, in which.

DETAILED DESCRIPTION OF THE PREFERRED EMBODIMENTS

Figure 1:
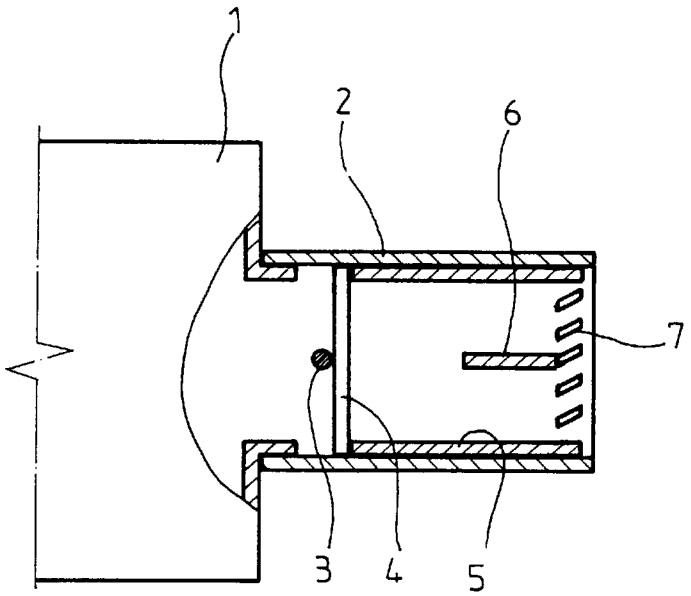
FIG. 1 presents a schematic sectional view illustrating an ion drag vacuum pump in accordance with one preferred embodiment of the present invention.
Figure 2:
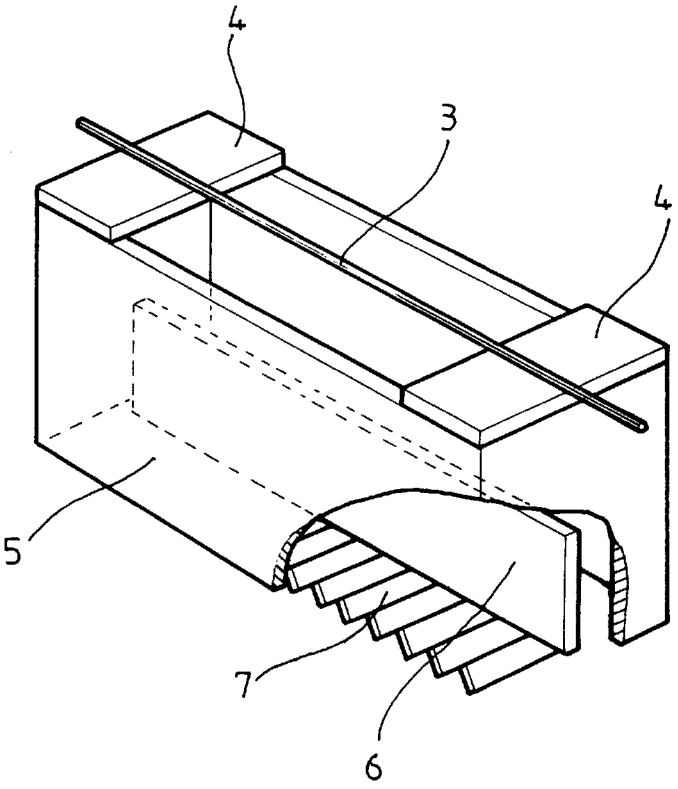
FIG. 2 represents a partially cut perspective view of the ion drag vacuum pump in FIG. 1.

FIG. 1 presents a schematic sectional view illustrating an ion drag vacuum pump in accordance with a first preferred embodiment of the present invention, and FIG. 2 represents a partially cut perspective view of the first preferred embodiment shown in FIG. 1.

The first preferred embodiment is a corona discharge ion drag vacuum pump. The corona discharge ion drag vacuum pump includes an elongate, e.g., wire-like, corona electrode 3 as a corona discharger, the corona electrode 3 having a diameter of 0.01 mm to 0.1 mm, a target electrode 5 attracting the positive ions generated through a corona discharge by the corona electrode 3 and speeding the ions up, a grounded baffle plate 7 for neutralizing and exhausting the speeded-up ions, and an auxiliary electrode 6 for helping the ions generated by the corona electrode 3 to speed up the ions. The corona electrode 3 is disposed on a pair of isolators 4 attached to one side of the target electrode 5 and the grounded baffle plate 7 is disposed on the other side of the target electrode 5. The corona discharge ion drag vacuum pump is installed in a body 2, one side of which is connected to and in communication with a sealed chamber 1.

Figure 3:
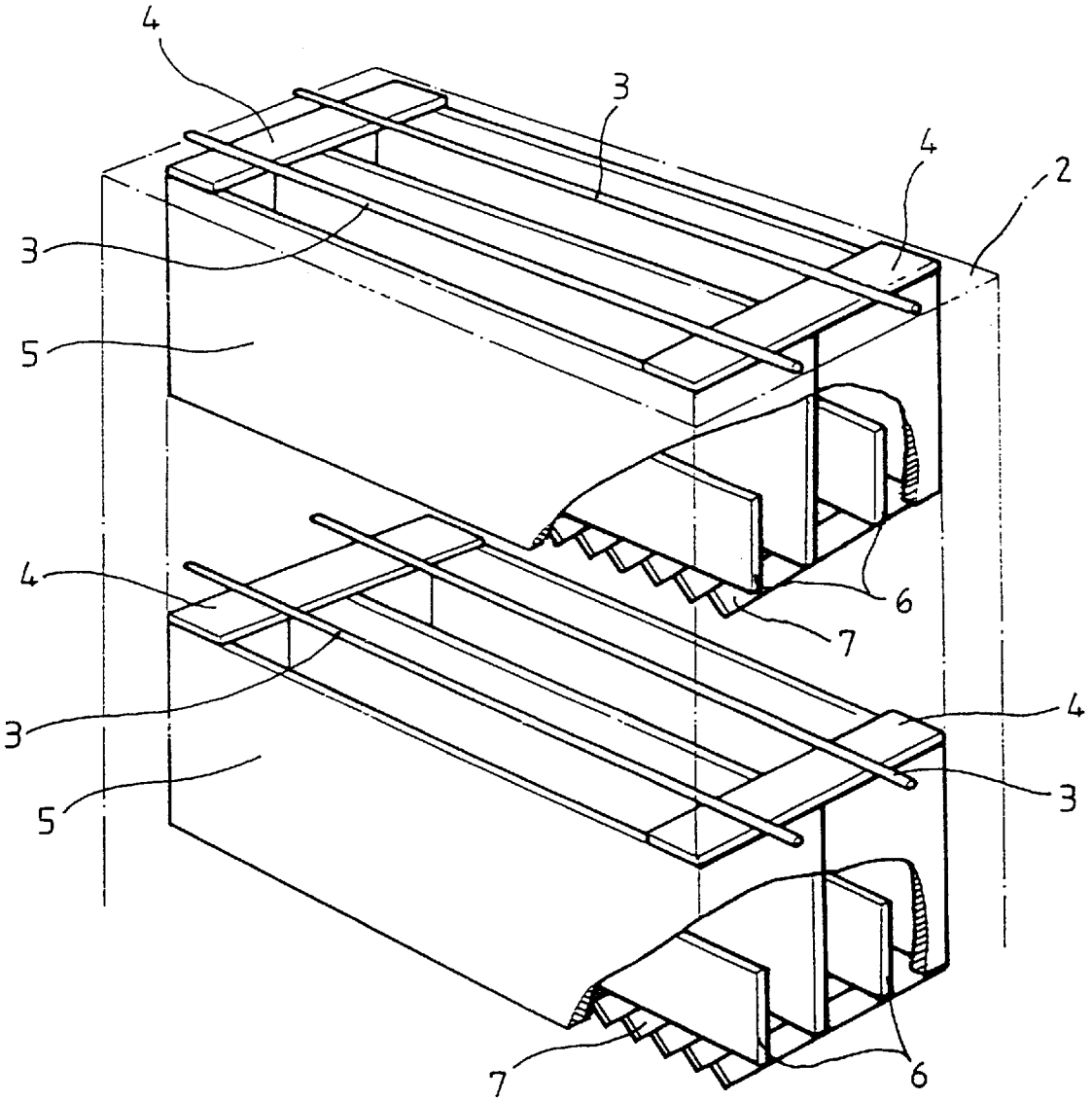
FIG. 3 provides a perspective view of an ion drag vacuum pump, wherein a pair of ion drag pumps in FIG. 1 is constructed in series.

There is shown in FIG. 3 a pair of corona discharge ion drag vacuum pumps arranged in series in the body 2.

Figure 4:
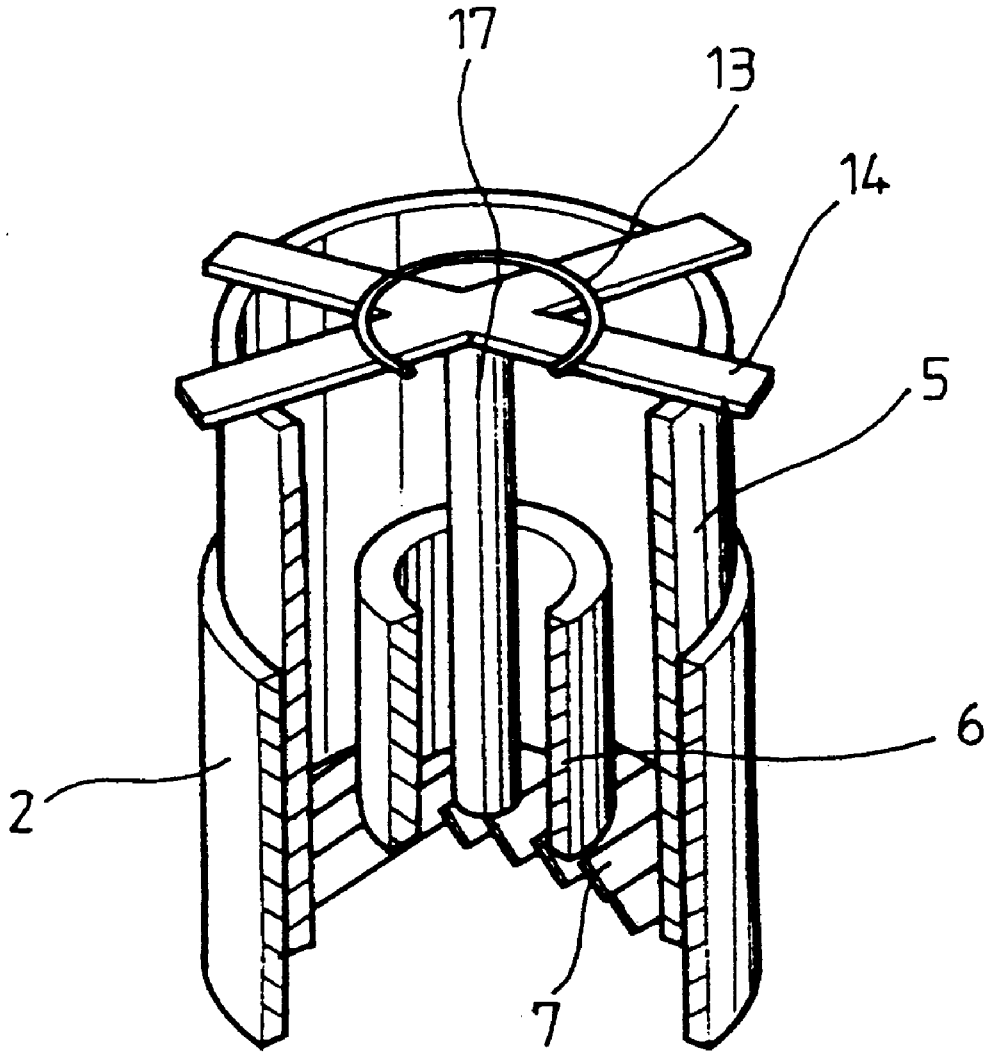
FIG. 4 illustrates a perspective view of the ion drag vacuum pump of the present invention, wherein the body is of a substantially cylindrical shape.

As shown in FIG. 4, if the body 2 is of a cylindrical shape, the corona discharge vacuum pump includes an X-shaped isolator 14 and a ring shaped corona electrode 13, a cylindrical target electrode 5, a grounded baffle plate 7, and a cylindrical auxiliary electrode 6. A pillar 17 is installed on a center portion of the ion drag vacuum pump.

Figure 5:
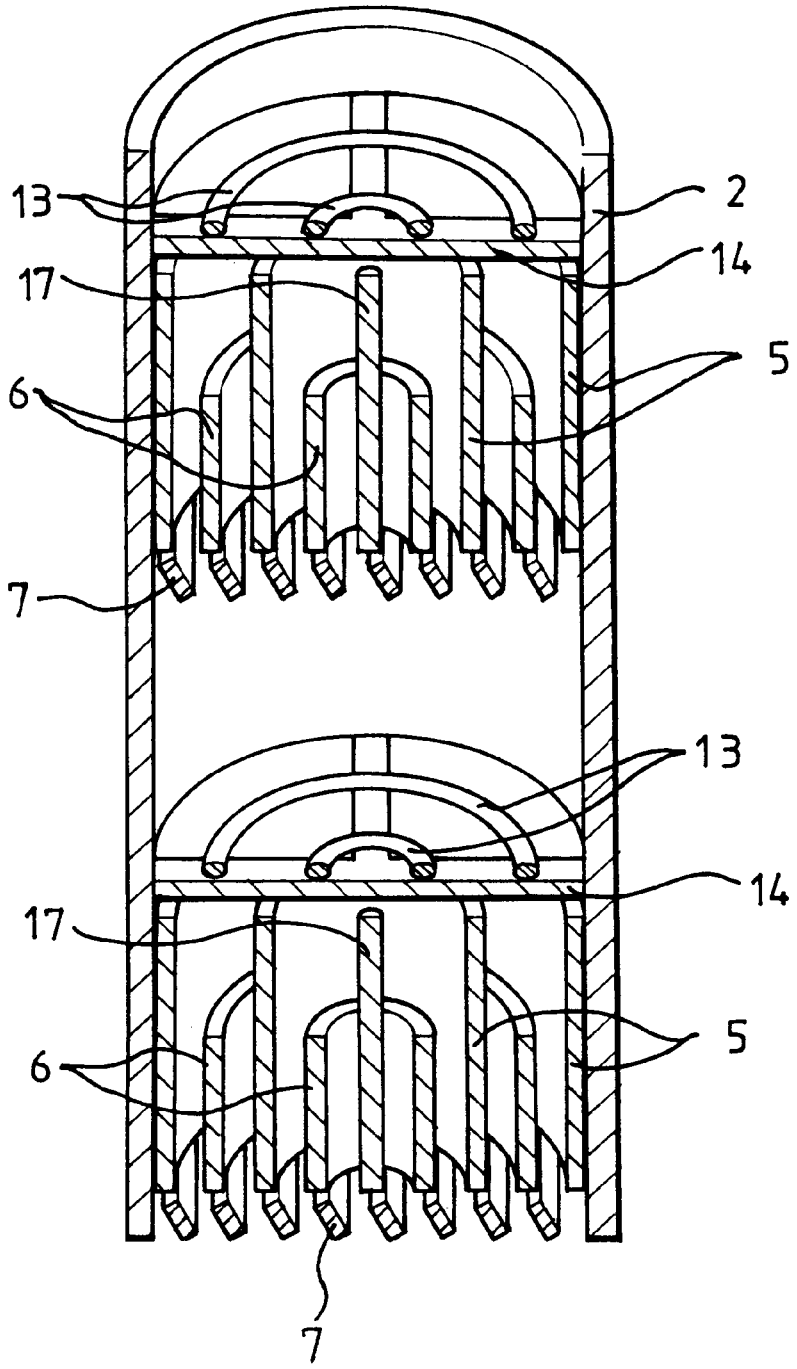
FIG. 5 depicts a perspective view of an ion drag vacuum pump, wherein a pair of ion drag pumps in FIG. 4 is constructed in series.

Referring to FIG. 5, a pair of corona discharge ion drag vacuum pumps shown in FIG. 4 may be arranged in series in the body 2.

It should be noted that three or more corona discharge ion drag vacuum pumps can be arranged in the body 2.

The inventive ion drag vacuum pump of first preferred embodiment with the above-mentioned construction operates as follows.

When a positive voltage of 5 to 30 kilo-volts is applied to the corona electrode 3, a corona discharge first occurs, generating ions; next, ions having positive charge among the generated ions are speeded up by the target electrode 5. The ions speeded up by the target electrode 5 collide with the gas molecules, forcing them to discharge secondary electrons whereby the ions lose kinetic energy to the gas molecules, the positive ions newly generated as a result of the collision are again speeded up by the target electrode 5, collide again with other gas molecules, transferring kinetic energy thereto or to newly ionize the gas molecules and are exhausted from the body 2. The positive ions are neutralized by the grounded baffle plate 7. When such processes are repeated, the charge and kinetic energy of the ions are transferred to the gas molecules so that the gas molecules are exhausted outside the body at a rapid speed. Accordingly, the density of gas at an entrance of the body 2 connected to the sealed chamber 1 becomes low, the gas in the sealed chamber 1 diffuses toward the entrance of the body 2 and exhausted outside, resulting in a vacuum pump capable of operating under atmospheric pressure.

Further, as shown in FIGS. 3 and 5, the ion drag vacuum pump can be arranged in series in the body 2 in order to improve the performance thereof.

Figure 6:
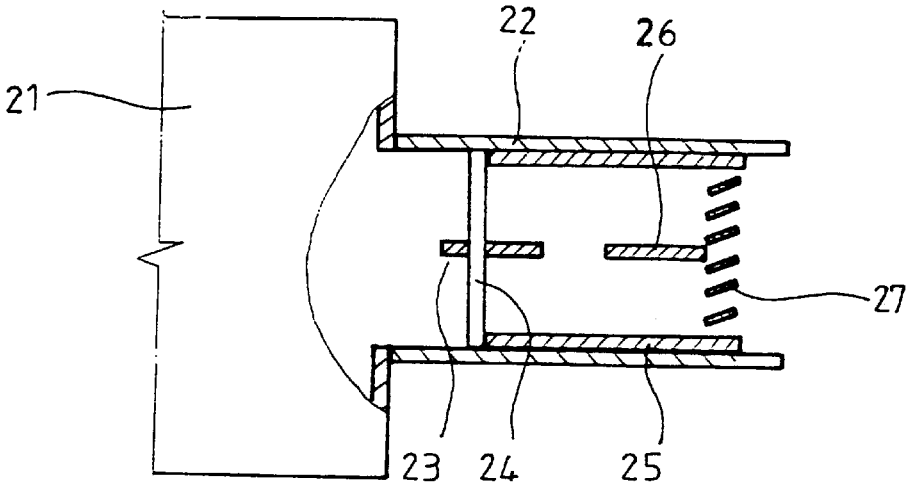
FIG. 6 shows a schematic view of an ion drag vacuum pump in accordance with a second preferred embodiment of the present invention.

FIG. 6 describes a DC glow discharge ion drag vacuum pump in accordance with a second preferred embodiment of the present invention, which is useful under a low pressure.

The second embodiment is similar to the first embodiment except that a metal plate electrode 23 is employed instead of the corona electrode 3 to generate positive ions. A positive high DC voltage is applied to the metal plate electrode 23 to ionize the ambient air. The DC glow discharge ion drag vacuum pump is installed in a body 22, one side of which is connected to and in communication with a sealed chamber 21. An isolator, a target electrode, an auxiliary electrode and a grounded baffle plate are designated generally by reference numerals 24, 25, 26 and 27, respectively.

Figure 7:
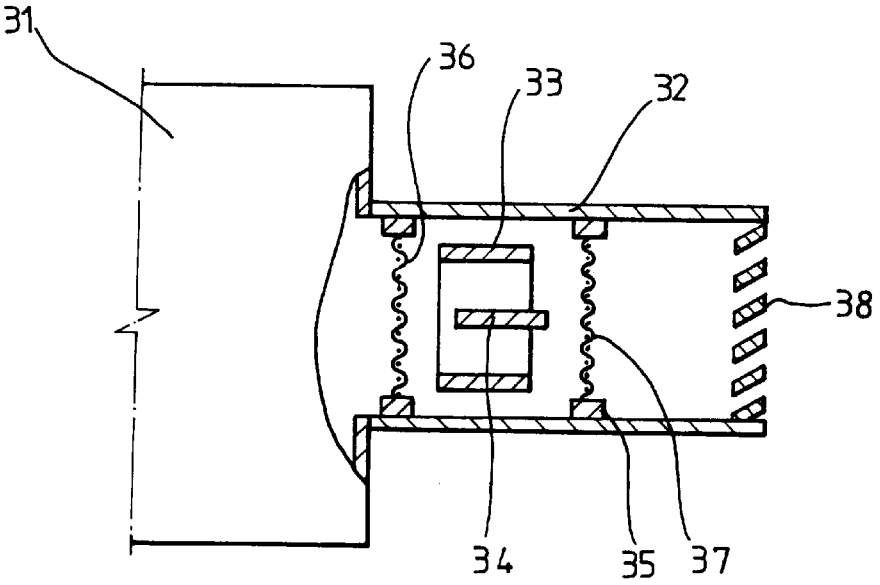
FIG. 7 offers a schematic view of an ion drag vacuum pump in accordance with a third preferred embodiment of the present invention.

FIG. 7 offers an RF glow discharge ion drag vacuum pump in accordance with a third preferred embodiment of the present invention. The RF glow discharge ion drag vacuum pump includes: (i) a first RF electrode 33 of a square pipe shape and a second RF electrode 34 of a plate shape installed in a body 32, the second RF electrode 34 being disposed inside the first RF electrode 33; (ii) a first and a second grids 36 and 37 which are respectively installed on both sides of the first electrode 33 and the second electrode 34 and to which a positive and a negative voltage are respectively applied; and (iii) a grounded baffle plate 38 for neutralizing the ions speeded up by the grids 36 and 37. Reference numeral 35 designates a grid holder for supporting the first and the second grids 36 and 37.

Figure 8:
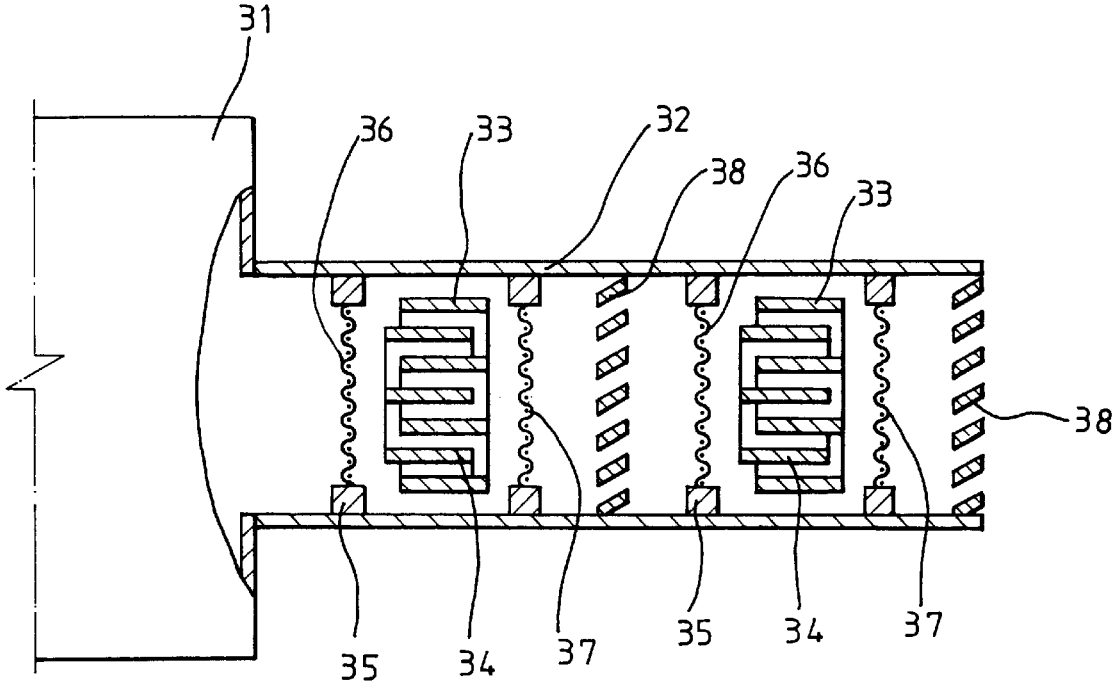
FIG. 8 gives a schematic sectional view of the ion drag vacuum pump in FIG. 7.

Again, a plurality of RF glow discharge ion drag pumps may be arranged in series in the body 32, as shown in FIG. 8.

The inventive ion drag vacuum pump of the third embodiment with the abovementioned construction operates as follows.

First, when RF power is applied to the first and the second RF electrodes 33 and 34, a glow discharge occurs between the first and the second RF electrodes 33 and 34 to thereby generate a plasma; next, electrons are repulsed by the second grid 37 and absorbed into the first grid 36, and the positive ions are repulsed by the first grid 36 and are speeded up by the second grid 37 and then collide with other neighboring gas molecules to thereby transfer kinetic energy and charge thereto, the positive voltage being applied to the first grid 36, the negative voltage being applied to the second grid 37; accordingly, gas within a vacuum chamber 31 is exhausted outside by the ion drag phenomenon by repeating the above processes.

The positive ions are first neutralized by the grounded baffle plates 38, and then are exhausted from the body 32.

Again, a plurality of RF glow discharge ion drag pumps may be arranged in series in the body 32, as shown in FIG. 8.

Figure 9:
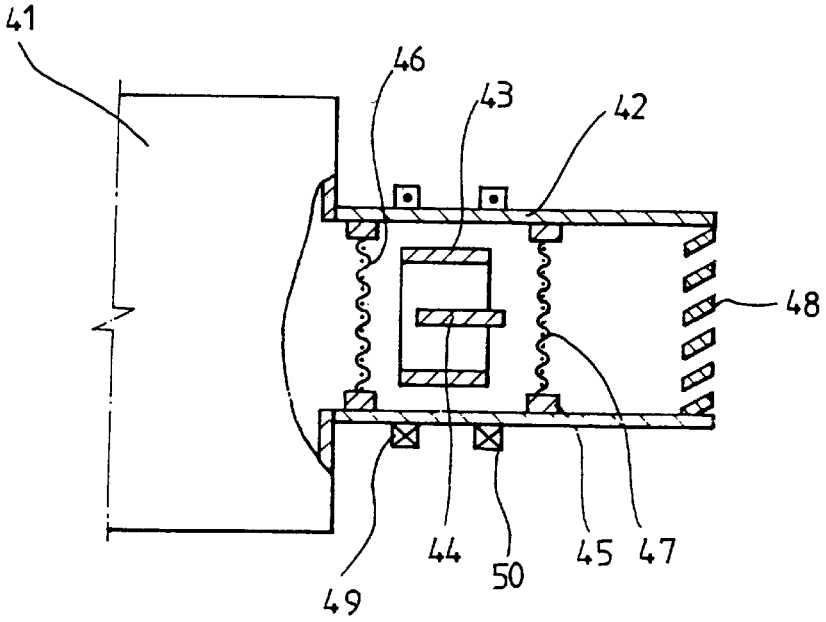
FIG. 9 describes a schematic sectional view of an ion drag vacuum pump in accordance with a fourth preferred embodiment of the present invention.

FIG. 9 illustrates a magnetron discharge ion drag pump in accordance with a fourth preferred embodiment of the present invention. The fourth embodiment is similar to the third embodiment except that two magnets 49 and 50 are disposed around a first and a second RF electrodes 43 and 44. The magnetron discharge ion drag pump is installed in a body 42, one side of which is connected to and in communication with a sealed chamber 41. A grid holder, a first grid, a second grid and a grounded baffle plate are designated generally by reference numerals 45, 46, 47 and 48, respectively.

The inventive ion drag vacuum pump of the fourth preferred embodiment with the above construction operates as follows.

First, when RF power is applied to the first and the second RF electrodes 43 and 44, an RF glow discharge occurs between the electrodes to thereby generate a plasma; next, since the generated plasma is made denser by two electromagnets 49 and 50, the discharge easily occurs even in a lower pressure; accordingly, the positive ions are speeded up towards the second grid 47 by the voltage difference between the first grid 46 and the second grid 47 to thereby exhaust the gas within a vacuum chamber 41 outside by the ion drag phenomenon.

And the positive ions are first neutralized by the grounded baffle plate 48 and then are exhausted from the body 42.

Figure 10:
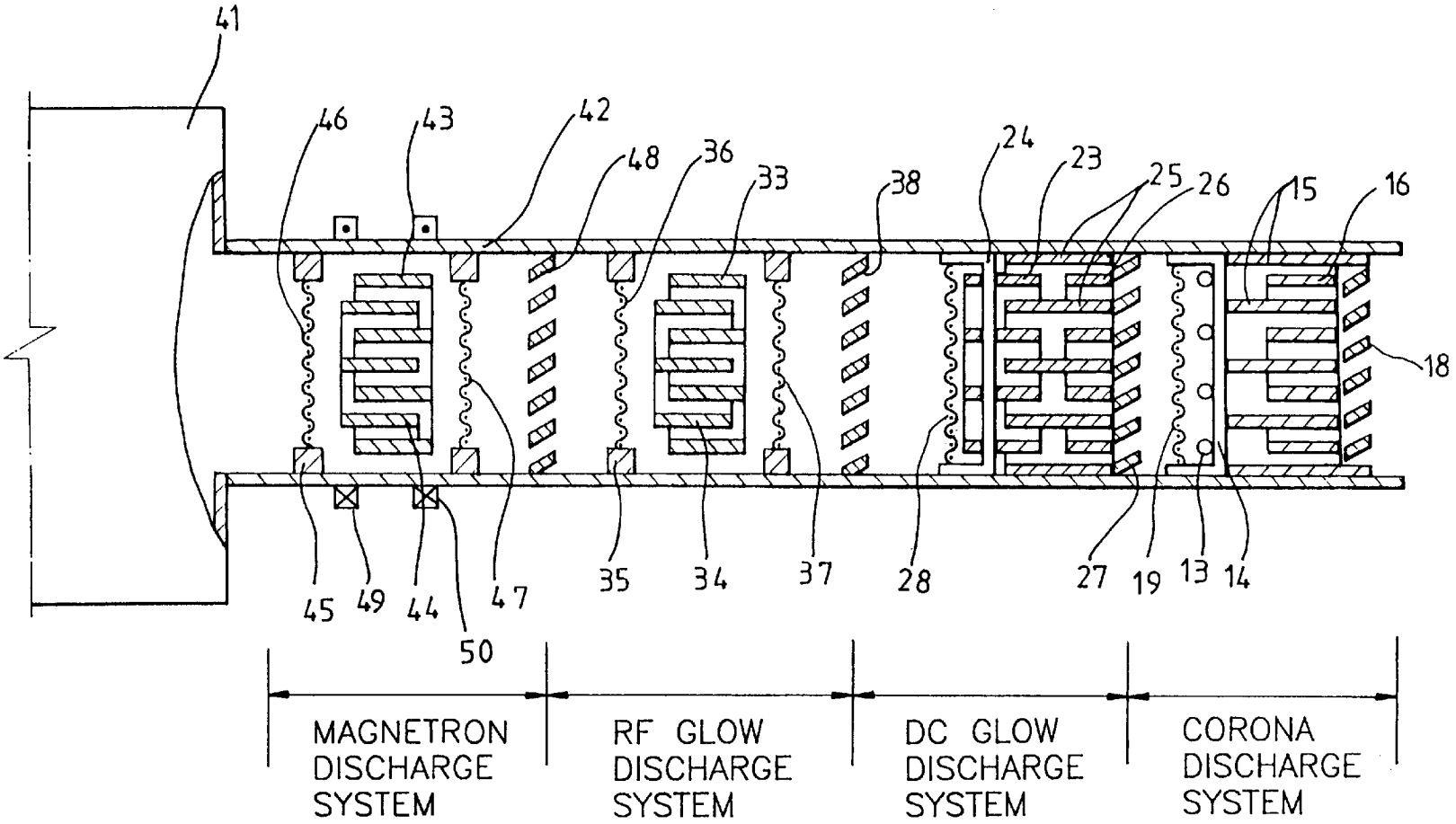
FIG. 10 sets forth a schematic sectional view of an ion drag vacuum pump in accordance with a fifth preferred embodiment of the present invention.

FIG. 10 provides an inventive composite ion drag vacuum pump in accordance with a fifth preferred embodiment of the present invention, wherein there are, in turn, arranged in the body 42 a first ion drag vacuum pump of the magnetron discharge system, a second ion drag vacuum pump of the RF glow discharge system, a third ion drag vacuum pump of the DC glow discharge system and a fourth ion drag vacuum pump of the corona discharge system.

In the fifth preferred embodiment, though four different types of ion drag vacuum pumps are installed in series in the body, two or three types of pumps selected and combined among them may be installed in the body depending on the pressure to be required.

Operations of the fifth preferred embodiment for the inventive ion drag vacuum pump with the above construction are as follows.

First, when RF power is applied to the first and the second RF electrodes 43 and 44, a glow discharge occurs between the RF electrodes 43 and 44 to generate the plasma, the generated plasma being made denser by a magnetic force of the electromagnet 49 and 50; next, the positive ions in the plasmas are speeded up by a voltage difference between the first and the second grids 46 and 47, dragging the neighboring gas molecules, and by an effect of such an ion drag, the gas is compressed and flows towards the second ion drag pump, and the positive ions are neutralized by the grounded baffle plate 48; thereafter, RF voltages are respectively applied to the first and the second RF electrodes 33 and 34 to cause the discharge, then the ions are speeded up by the first and the second grids 36 and 37, and by an effect of such an ion drag, the gas is compressed and is exhausted towards the third ion drag pump; and then, a positive DC voltage is applied to the metal electrode 23 to cause the glow discharge and to thereby generate ions, the generated ions being speeded up by the target electrode 25 and the auxiliary electrode 26 to bring about the ion drag phenomenon, compressing the gas towards the fourth ion drag pump, and the gas being neutralized by the grounded baffle plate 27 to become high pressured enough to cause the corona discharge, and then are exhausted towards the fourth ion drag pump; finally, a positive voltage is applied to the corona electrode 13 to cause the corona discharge to thereby generate ions, the generated ions being speeded up by the target electrode 15. In this way, the gas within a sealed chamber 41 is exhausted outside. On the other hand, provided on the respective upper portions of the third and the fourth ion drag pumps are grids 28 and 19, respectively, which prevent the generated ions from flowing backward.

The positive ions to be exhausted from the body 42 are neutralized by the grounded baffle plate 18 and then are exhausted outside. Meanwhile, the magnetron ion drag vacuum pump is used when a low pressure is required, and also the RF glow discharge, the DC glow discharge and the corona discharge ion drag vacuum pumps are used depending on the pressure requirement. The ion drag vacuum pumps may be combined in two, three or four series to thereby provide a composite ion drag vacuum pump capable of operating in $10^{-2}$ Pa to an atmospheric pressure.

As aforementioned, in the ion drag vacuum pump in accordance with the present invention, there is no vibration, noise and contamination caused in the dynamical vacuum pump being currently used, e.g., a rotary pump etc., since the inventive pump has no moving part, and furthermore it can operate under atmospheric pressure without any back-up pump.

Although the invention has been shown and described with respect to the preferred embodiments, it will be understood by those skilled in the art that various changes and modifications may be made without departing from the spirit and scope of the invention as defined in the following claims.

What is claimed is:

1. An ion drag vacuum pump comprising:

a body, on side of which is connected to and in communication with a sealed chamber;

means disposed in the body for generating ions;

means disposed in the body for dragging positive ions generated by the ion generating means to thereby exhaust gases located near the ions outside by speeding up the ions;

means for neutralizing the positive ions;

wherein the ion generating means includes a corona electrode as a corona discharger, to which a positive voltage is applied, the ion dragging means includes a target electrode, one side of which is disposed near the corona electrode, the target electrode attracting the positive ions generated by a corona discharge of the corona electrode and speeding the positive ions up, and the ion neutralizing means includes a grounded baffle plate installed at the other side of the target electrode.

2. The pump of claim 1, wherein the corona electrode is disposed on an isolator attached to the target electrode.

3. The pump of claim 1, wherein an auxiliary electrode for helping the positive ions generated by the corona electrode to speed up, the auxiliary electrode being installed inside the target electrode.

4. The pump of claim 1, wherein the corona electrode is an elongated wire having a diameter of 0.01 mm to 0.01 mm.

5. The pump of claim 1, wherein the ion generating means includes a metal plate as a DC glow discharger, to which a positive DC voltage is applied, the ion dragging means includes a target electrode, one side of which is disposed near the metal plate, the target electrode attracting the ions generated by a DC glow discharge of the metal plate and speeding the ions up, and the ion neutralizing means includes a grounded baffle plate installed at the other side of the target electrode.

6. The pump of claim 1, wherein the ion generating means includes a first RF electrode and a second RF electrode disposed inside the first RF electrode, a glow discharge occurring between the first and the second RF electrodes to thereby generate a plasma when RF power is applied to the first and the second RF electrodes; the ion dragging means includes a first and a second grids which are respectively installed on both sides of the first electrode and to which a positive and a negative voltage are respectively applied, positive ions generated by the ion generating means being repulsed by the first grid and speeded up by the second grid; and the ion neutralizing means includes a grounded baffle plate.

7. The pump of claim 6, wherein a pair of magnets for making the plasma denser are disposed around the first and the second RF electrodes.

8. A composite ion drag pump comprising:

a body, one side of which is connected to and in communication with a sealed chamber;

a magnetron discharge ion drag pump disposed in and near the entrance of the body, the magnetron discharge ion drag pump including a first RF electrode and a second RF electrode disposed inside the first RF electrode, a glow discharge occurring between the first and the second RF electrodes to thereby generate a plasma when RF power is applied to the first and the second RF electrodes, a pair of magnets for making the plasma denser, the magnets being disposed around the first and the second RF electrodes, a first and a second grids which are respectively installed on both sides of the first electrode and to which a positive and a negative voltage are respectively applied, positive ions generated by the ion generating means being repulsed by the first grid and speeded up by the second grid, a grounded baffle plate for neutralizing the positive ions; and a corona discharge ion drag pump disposed downstream of the magnetron discharge pump, the corona discharge ion drag pump including a corona electrode as a corona discharger, to which a positive voltage is applied, a target electrode, one side of which is disposed near the corona electrode, the target electrode attracting the positive ions generated by a corona discharge of the corona electrode and speeding the positive ions up, and a grounded baffle plate for neutralizing the positive ions, the third grounded baffle plate being installed at the other side of the target electrode.

9. The composite ion drag pump of claim 8, further comprising: a RF glow discharge ion drag pump disposed between the magnetron discharge ion drag pump and the corona discharge ion drag pump, the RF glow discharge ion drag pump including a first RF electrode and a second RF electrode disposed inside the first RF electrode, a glow discharge occurring between the first and the second RF electrodes to thereby generate a plasma when RF power is applied to the first and the second RF electrodes, a first and a second grids which are respectively installed on both sides of the first electrode and to which a positive and a negative voltage are respectively applied, positive ions generated by the ion generating means being repulsed by the first grid and speeded up by the second grid, a grounded baffle plate for neutralizing the positive ions.

10. The composite ion drag pump of claim 9, further comprising: a DC glow discharge ion drag pump disposed between the RF glow discharge pump and the corona discharge ion drag pump, the DC glow discharge ion drag pump including a metal plate as a DC glow discharger, to which a positive DC voltage is applied, a target electrode, one side of which is disposed near the metal plate, the target electrode attracting the ions generated by a DC glow discharge of the metal plate and speeding the ions up, and a second grounded baffle plate for neutralizing the positive ions, the second grounded baffle plate being installed at the other side of the target electrode.

* * * * *